United States Patent [19]

Korczynski et al.

[11] Patent Number: 5,004,994

[45] Date of Patent: Apr. 2, 1991

[54] PUSH-TO-TRIP HIGH-AMP CIRCUIT BREAKER

[75] Inventors: Jacek M. Korczynski, Niles; Thomas J. Stack, Chicago, both of Ill.

[73] Assignee: Cooper Industries, Inc., Houston, Tex.

[21] Appl. No.: 528,312

[22] Filed: May 24, 1990

[51] Int. Cl.[5] ..... H01H 71/16

[52] U.S. Cl. ..... 337/66; 337/68

[58] Field of Search ..... 337/66, 68, 91, 56, 337/75, 72

[56] References Cited

U.S. PATENT DOCUMENTS

| | | | |
|---|---|---|---|
| 2,720,416 | 10/1955 | Raleigh | 337/89 |
| 3,723,929 | 3/1973 | Sitar | 337/72 |
| 4,814,739 | 3/1989 | Moldovan | 337/68 |

*Primary Examiner*—H. Broome

*Attorney, Agent, or Firm*—Nelson A. Blish; Eddie E. Scott; Alan R. Thiele

[57] ABSTRACT

A low voltage high-amp circuit breaker (20) having a substantially reactangular bimetallic bistable element (41). The bistable element is attached to have one end move from a first normal electrically conductive position to a second non-electrically conductive position. The manual reset circuit breaker includes a manual reset lever (29) and a non-conductive heat resistant extension blade (64) connected to the reset lever via a rotatable shaft (56). The extension blade being positioned adjacent the moveable end of the bistable element and when the element is moved to its second position, the blade is moved to prevent the element from returning to its first conductive position until the circuit breaker is manually reset. A push-to-trip button (80) pushes plate (88) downward causing fingers (84) to move upward lifting bracket (92) to deform bistable element (41) placing the breaker in an open circuit condition.

11 Claims, 4 Drawing Sheets

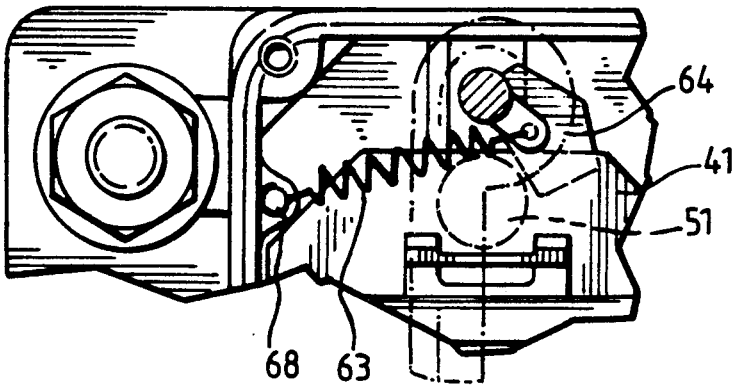
FIG.7
FIG.8
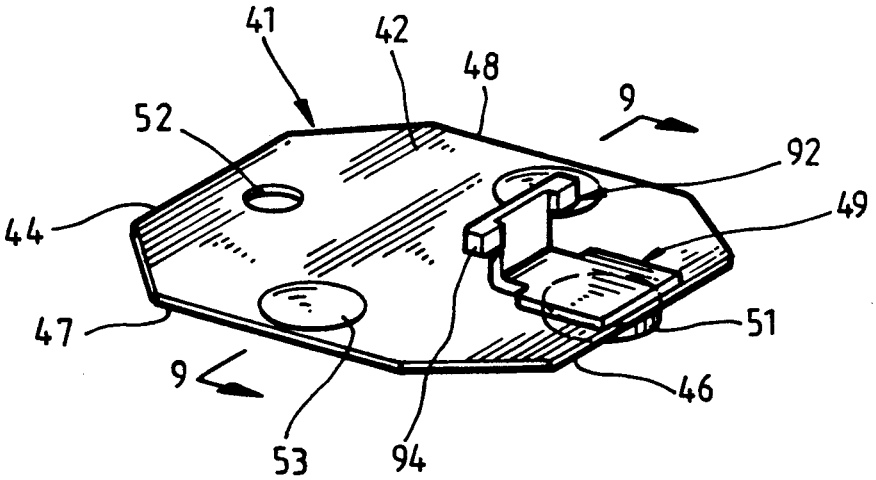
FIG.9
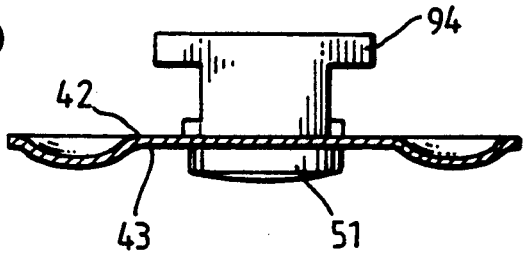

PUSH-TO-TRIP HIGH-AMP CIRCUIT BREAKER

The present invention relates to a high-amp circuit breaker assembly in general and more particularly a breaker having a manual reset mechanism which utilizes a substantially rectangular, bimetallic, bistable, thermally active element to provide for overload protection, and manual trip means to place the breaker in an open circuit condition.

BACKGROUND

Circuit breakers when mounted through a panel on a surface usually have their terminals on different sides of the circuit breaker assembly. The manual reset circuit breakers are generally constructed so that it is not readily seen that the circuit breaker has opened to protect the circuit from an overload or a surge in current.

Both the manual and the auto reset high amp circuit breaker assemblies which are generally available are relatively difficult to manufacture. The bimetallic bistable elements used to open and close the breaker circuit usually require a relatively complex structure to operate with the quickness that is necessary to protect a circuit from damage. The structure used is a cylindrical bimetallic disc that has a small clearance hole at the center. The disc is then stamped into a dome shaped element via a radial forming die. A finely threaded screw is placed through the center hole and engaged into a mating female thread within the units main housing. The screw is tightened to preload the central dome or hump. The disc has a pair of contacts on opposite sides of the diameter. In the assembly the disc contacts have corresponding contacts attached to termination lugs. When the disc circuit breaker encounters an over-current, the disc goes from concave to convex to open the circuit and returns in the automatic reset style when the over-current is not present and a predetermined time has past to allow the element to sufficiently cool. The manual reset style operates similarly except that the bistable element is over-stressed so that when an over-current causes the convex condition, the element must be returned to the concave form by physical force via a push-button resetting mechanism.

These types of circuit breakers for low voltage DC applications with high amperage rating utilize generally large and broad forming radii that as a process exhibits high variability. This results in circuit breakers which are relatively costly to manufacture because the manufacturing process is labor intensive. Each unit has to be individually calibrated at the factory. The center adjusting screw for each unit must be manually tightened to bring the contacts into a pre-load condition. Then each unit must be tested to be sure it is properly calibrated to open and close as required to protect a circuit.

Present circuit breakers do not provide a means for manually placing the circuit breaker in an open circuit condition, thus the time consuming and difficult step of disconnecting the batteries is often necessary.

Some existing circuit breakers provide a means to work on electrical equipment without disconnecting a battery terminal or otherwise removing the electrical source from the circuit; however, they are relatively expensive, complex, and not available or suitable in this class of low voltage, high current D.C. design.

SUMMARY OF THE INVENTION

In accordance with one embodiment of the invention, a bistable thermally active element is rectangular with a width greater than ½ of its length. One end of the element is fixed and the other end has a contact attached thereto. The other end with contact attached is the moveable end and snaps from a first normal position to a second position. The snap action of this bistable element and its inherent electrical resistance determine the opening point particular over-load amperage. The element has at least one dimple formed thereon to provide the desired snap action.

In another embodiment of the invention, a low voltage high amp circuit breaker includes a housing and one pair of terminals fixed to the housing and extending from the same outer side of the housing. In yet another embodiment of the invention, a low voltage high amp circuit breaker includes a housing and one pair of terminals fixed to the housing and extending from the opposite side of the housing. Within a cavity formed in the housing are first, second and third contacts electrically connected respectively to said bistable element and said pair of terminals. The first fixed contact is fixedly attached to one end of a rectangular thermally responsive bimetallic bistable element.

Attached to the other end of the bistable element is a contact. The second contact is positioned relative to the fixed third contact so that they are normally in electrical contact. The element is so calibrated that when an overload is encountered the element's active end snaps to a second position which separates the second contact from a third fixed contact attached to a terminal in close proximity to the second contact to open the circuit of the circuit breaker. After a predetermined time, the element is calibrated to snap back into its first position. The element has at least one dimple formed thereon.

In a further embodiment of the invention there is a manual-reset high-amp circuit breaker having a generally central closed cavity. The rectangular, bistable, thermally responsive element, as described above is mounted in said cavity. The one end of the bistable element is fixed to a contact for a first terminal and is generally not moveable. The other end of the bistable element has a second contact thereon that is normally in electrical contact with a third contact that is for the second terminals. A rotatable shaft is mounted in the cavity and extend outside of the housing. A manual reset lever is attached to the rotatable shaft and pivots when the shaft rotates. An extension blade is attached to the shaft and positioned adjacent the element contact. A spring means is attached to said shaft. The extension blade and spring are positioned so as not to interfere with the normal "on" position of the circuit breaker, i.e., electrical contact occurs between the second and third contacts to assure a current flow through the device. However, when there is an overload and the second contact snaps away from the third contact, the spring turns the shaft to position the extension blade between the second and third contacts. The reset lever is rotated and visually shows that the circuit breaker is in its open condition. When the overload condition is terminated and a predetermined time has passed, the second contact is prevented from contacting the third contact by the extension blade. The circuit breaker remains open, or tripped, and nonconducting until it is manually reset.

The reset lever is attached to the shaft so that when the reset lever is manually pivoted to its reset position, the extension blade is moved from between the second and third contacts to a ready non-insulating position and the second and third contacts return to their "on" or electrical contact position. The reset lever and both terminals are all on the same external side of the housing to provide for easy visual means to determine the condition of the circuit breaker and to provide an easy electrical access to the circuit breaker.

And yet another embodiment of the invention, a manual trip button is provided which manually separates the second and third contacts to the open circuit position. In the open circuit position, the extension blade attached to the rotatable shaft then rotates between the second and third contact as described above and holds the breaker in the open circuit position until it is manually reset.

BRIEF DESCRIPTION OF THE DRAWINGS

FIG. 7 is an enlarged partial sectional view of FIG. 4;

FIG. 8 is a top perspective view of the bimetallic bistable element of the present invention;

FIG. 9 is a sectional view taken along lines 9—9 of FIG. 9; and

DESCRIPTION OF PREFERRED EMBODIMENTS

Figure 1:
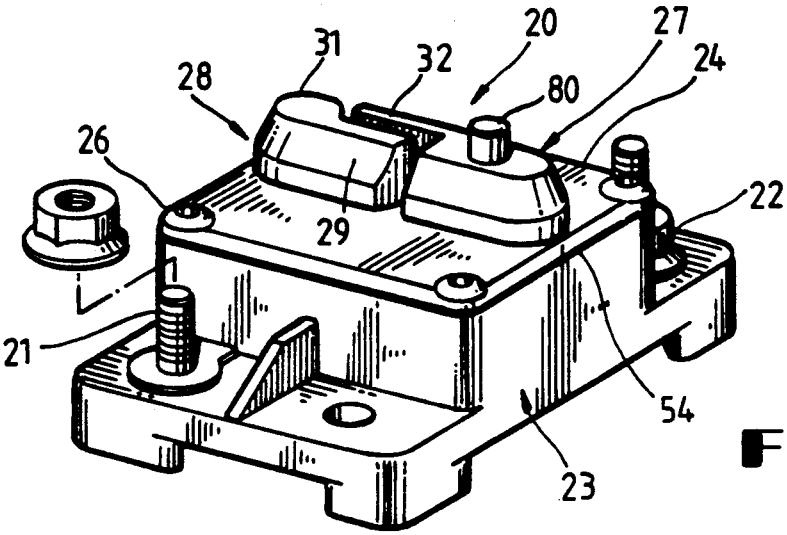
FIG. 1 is a top, front, right perspective view of a surface mounting type circuit breaker of the present invention having a manual reset and push-to-trip mechanism.
Figure 2:
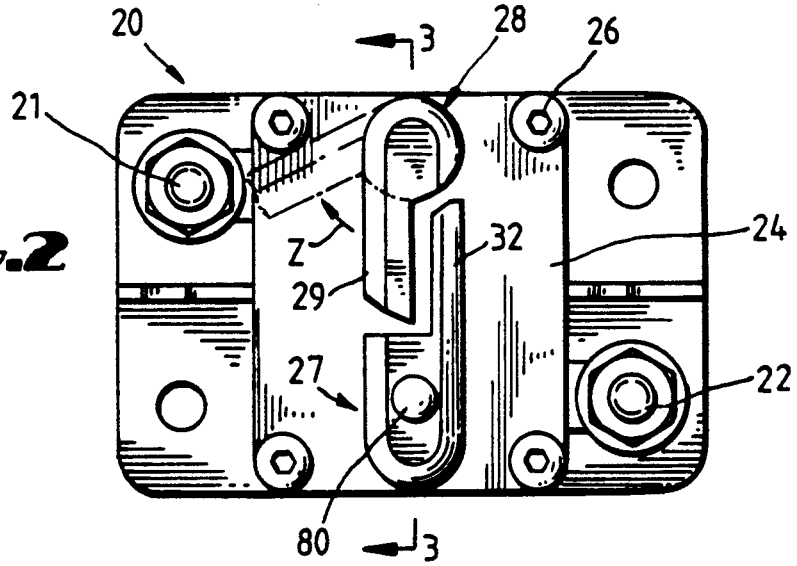
FIG. 2 is a top plan view of FIG. 1.

Referring to FIG. 1 and 2, we show a surface mount high-amp manual reset circuit breaker 20. The circuit breaker has two external terminals 21, 22 extending from the same external side of the breaker. The terminals are preferably mounted on opposite sides of a central housing 23. Thus, the terminals may be reached easily from one side of the circuit breaker.

On top of the central housing cover 24 is a blank preferably hollow raised housing 27 and a pivoting reset lever 28. The reset lever has a handle 29 which pivots about its end 31 as is described in more detail below. Blank housing 27 is utilized to give an aesthetic appearance to the circuit breaker and is shaped to complement the features of the reset lever. Also, a stationary portion 32 prevents the reset lever handle 29 from being accidentally turned in the direction of the stationary portion 32. If there was no stop means 32, the accidental turning of the reset handle 29 during shipping or use would most likely damage the circuit breaker and require replacement. The manual reset lever is in a side by side fit with the blank housing and is rotated or pivoted in the direction Z shown when there is an overload current of a predetermined magnitude. When the reset lever is pivoted to its trip position (shown in phantom in FIG. 2), the circuit of the circuit breaker is opened to prevent electricity from passing therethrough. After the overload condition ceases and a predetermined time has passed the reset lever handle 29 can be returned manually to the position shown in FIGS. 1 and 2 and return the circuit breaker to its closed circuit position. Push-to-trip button 80 may be used to manuallY place the breaker in an open circuit condition as described in more detail below.

Figure 3:
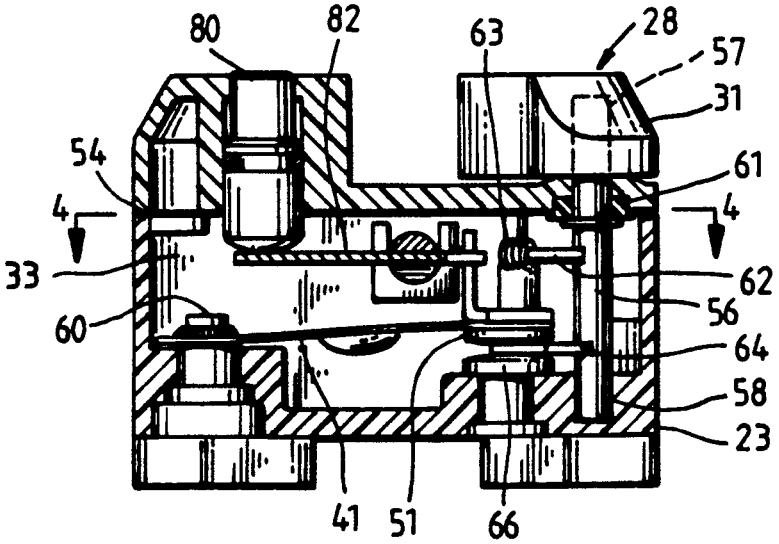
FIG. 3 is a cutaway view along lines 3—3 of a circuit breaker according to the present invention incorporating a push-to-trip button.
Figure 4:
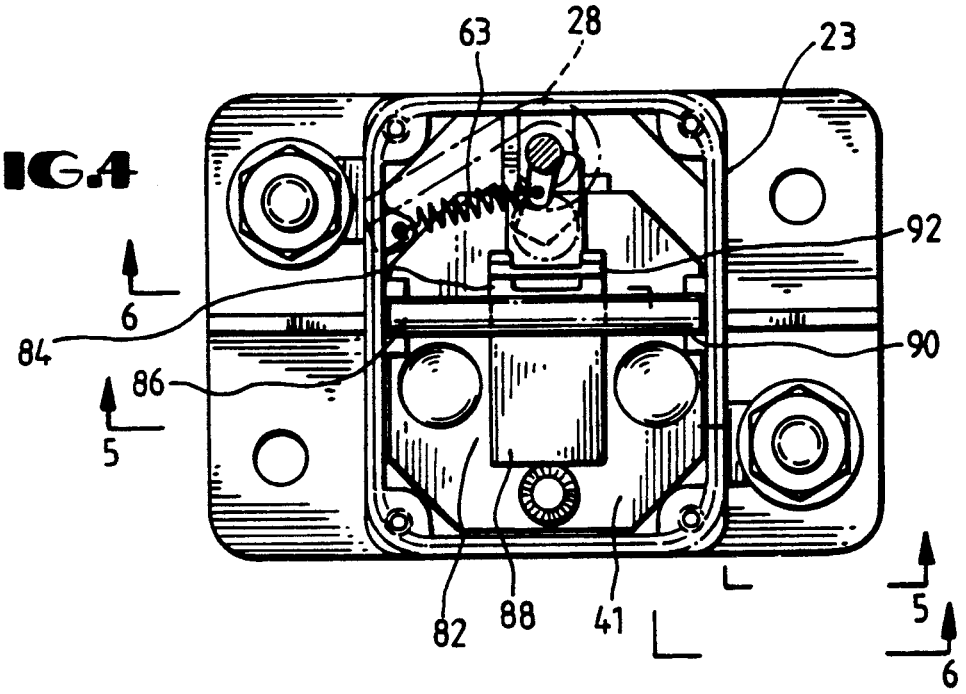
FIG. 4 is a partial top sectional view taken along lines 4—4 of FIG. 3.
Figure 5:
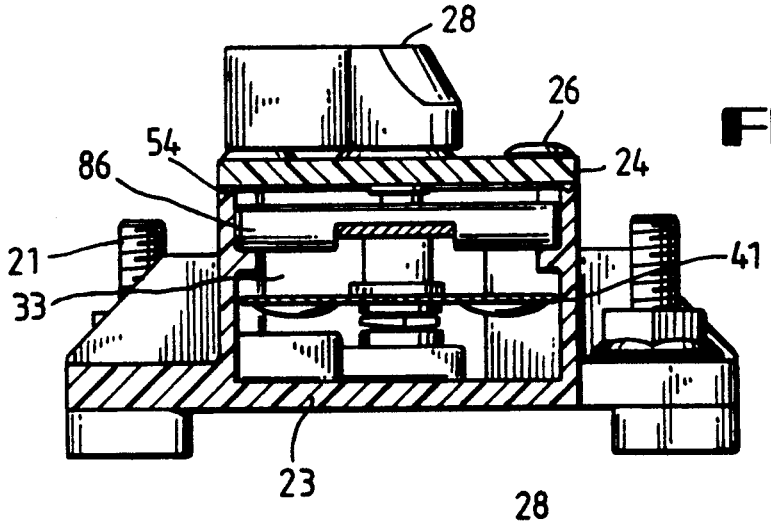
FIG. 5 is a partial section view taken along lines 5—5 of FIG. 4.
Figure 6:
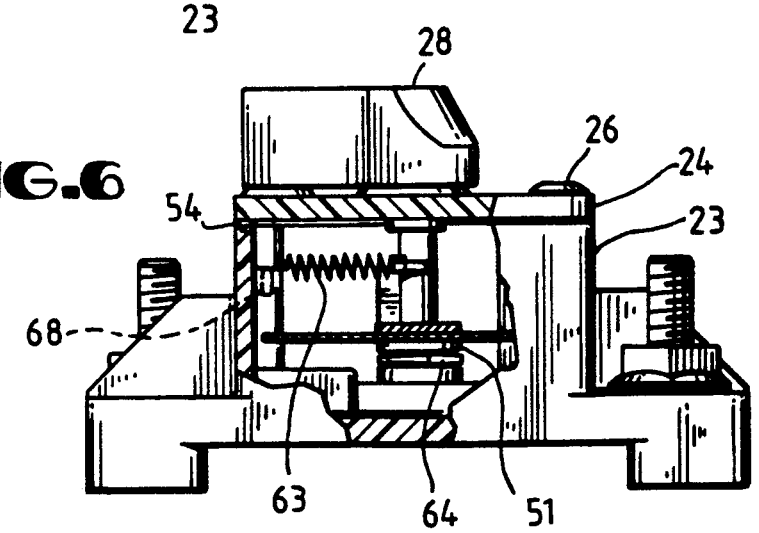
FIG. 6 is a partial sectional view taken along lines 6—6 of FIG. 4.

A bimetallic, bistable, thermally activated element 41, shown in FIGS. 3 , 5, and 8 are mounted in the cavity 33. The bistable mechanical element is manufactured to have a predetermined over current snap action. The bistable element 41 in a non-overload condition is in a first relatively horizontal position as shown in FIG. 5. When there is an overload, the bistable element heats up and deflects to snap into a second position (not shown.)

Figure 10:
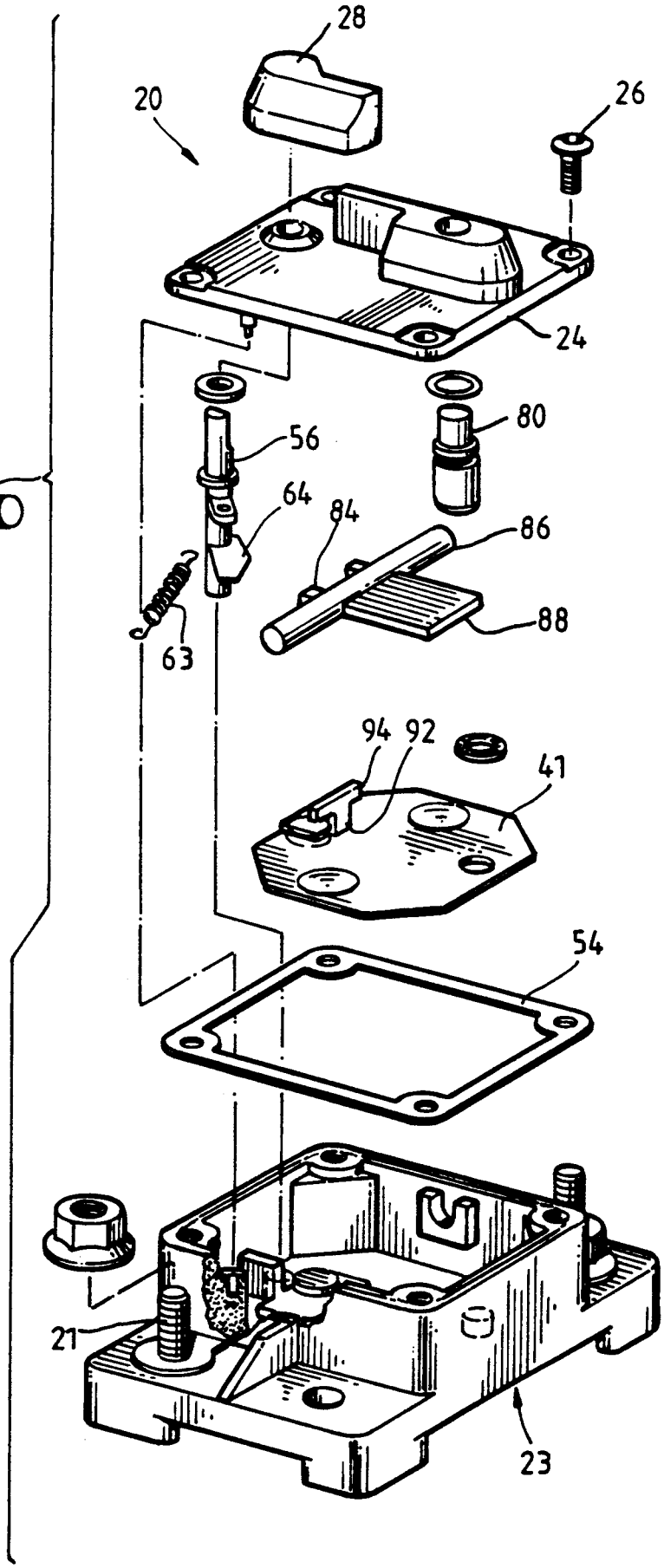
FIG. 10 is a perspective view, disassembled, of a circuit breaker according to the present invention.

The bimetallic bistable element 41 is best shown in FIGS. 8–10. The bistable element is a known thermally reactive composite alloy. The bistable element has a top surface 42, bottom surface 43, a fixed end 44, a moveable end 46 and two sides 47, 48. A weld disc 49 and a preferably high silver content contact 51 are welded to the moveable end 46 of the element. The weld disc is attached to the top surface 42 and the contact 51 to the bottom surface 43. Both the contact 51 and the weld disc 49 extend inwardly from the top edge of the end 46 and are preferably in the center of the end 46.

Hole 52 is located on end 44. Adjacent each side 47 and 48 is a dimple 53. The dimples are concave on the top surface 42, convex on the bottom surface 43. The length of the element is 1 5/16 to 1½ inches and the width is 1 to 1 ¼ inches. Thus, the width is greater than ½ the length.

The bistable elements of the present invention can be accurately calibrated in mass. Bistable elements for a particular overload will generally all have the same size having the same number and size of dimples and made from the same material. Thus, only a representative sampling of the bistable elements and their respective high-amp circuit breakers are necessary. The advantages of mass producing the circuit breakers without the necessity of having individual calibration is one of the advantageous economical features of the present invention. The high-amp low voltage circuit breakers which were generally used prior to this invention, use a disc construction which requires almost individual calibration.

Referring to FIGS. 3 and 5, the manual reset circuit breaker has an insulating plastic central housing 23 and a insulating plastic cover 24. The cover is sealed to the housing. Although rivets 26 are used to fix the cover to the housing, any appropriate fastening means can be used. Between the cover and the housing is an appropriate seal 54 which extends over the entire body cavity.

Within the body cavity 33 and adjacent end wall 39, there is located a rotatable non-conductive insulating shaft 56. The shaft 56 has two ends 57, 58. The one end 58 is inserted in a blind hole 59 formed in the base of the cavity and its other end 57 extending outside of the cavity and through the cover 23 for a predetermined distance. Another seal 61 aids in the sealing of the shaft 56 from the exterior of the housing cover.

The manual reset lever 28 is pressure fitted onto the rod end 57 to provide the arrangement shown in FIG. 1, 2, and 3. Therefore, when the circuit breaker is open, the reset lever is rotated or pivoted in the direction Z for a predetermined distance. The rotated reset handle is a visual indication that the breaker must be reset. The resetting must be done manually.

The shaft or rod 56 has a first spring attaching bar 62 integrally extending therefrom. This bar 62 is used to connect one end of an extension spring 63. Spaced a predetermined distance below the first bar is a non-conductive heat resistant second extension bar or extension blade 64. The second extension blade 64 extends a predetermined distance substantially radially from the shaft 56.

The extension blade is spaced a predetermined distance above the base of the housing. Preferably, the extension blade has a rudder-like or similar form with a first straight edge, a predetermined width and a rounded portion. The size and length of the second extension blade 64 is determined so that it ca fit between the element contact 51 and a terminal contact 66 to maintain an electrical insulation therebetween and to keep the two contacts separated if desired. This will be described in greater detail hereinafter.

The bistable element 41 is mechanically staked at its one end 44 to the first terminal contact 67. The bistable element is sized and the rotatable shaft 56 is mounted in the cavity such that the other end 46 is adjacent to the rotatable shaft. The mounting height of the bistable element in the cavity is such that the contact 51 is generally in the same plane as the second extension blade 64. The flat side surface of the second extension blade 64 rests against the end surface of the circular element contact 51 when the breaker circuit is in its closed position.

The second extension blade 64 is urged towards the contact 51 by the extension spring 63 which has its other end connected to the cover attachment and spring holder 68. This cover attachment and spring holder 68 is located on one side of the inside of the housing.

The second terminal has located within the housing the stationary contact 66 which is situated just below the element contact 51, adjacent to the rotatable shaft 56 and below the second extension blade 64. The extension blade is such that it extends at least to the center of the element contact 51 and the terminal contact 66 when the circuit breaker is in its open position.

Push-to-trip button 80 is slidably mounted in raised portion 27 of cover plate 24. The lower portion of button 80 rests against lift arm 82. Lift arm 82 is comprised of fingers 84, bar 86, and plate 88. Bar 86 rests in slots in housing 23. Lift bracket 92 is attached to weld disk 49 of bimetallic biseal element 41. Lift bracket 92 has arms 94 which normally rests on fingers 84 of lift arm 82.

In operation, the high-amp circuit breaker is in its normal closed position as shown in FIG. 7. The spring 63 is in its extended position urging the extension blade 64 towards and against the element contact 51. The terminal contact 66 and the element contact 51 are in electrical contact with each other. When there is a predetermined overload in a circuit connected via terminals 21 and 22, the bistable element 41 snaps its end 46 to the second position wherein the element contact is raised a predetermined distance above the terminal contact and the blade 64 is then moved between the two contacts shown in FIG. 3. The blade 64 in this position electrically insulates the two contacts from each other and prevents contact 51 from contacting terminal contact 66 until the breaker is reset. Referring to FIG. 2, when there is an overload, the reset lever is moved in a direction such that the handle is moved away from the blank housing as shown in phantom. In a preferred embodiment there will be a yellow or iridescent label that will indicate the circuit breaker needs resetting. However, even without the indication, it is readily observable that the breaker needs to be reset.

The resetting is a quick and easy operation. The lever is merely turned towards the blank housing and the shaft is rotated such that the extension blade 64 is moved from between the element contact 51 and the second terminal contact 66. The spring 63 is extended. As soon as the extension blade 64 is removed from between the two contacts 51 and 56, the element contact 51 returns to the position shown in FIG. 5 and the extension blade 64 contacts the side of the element contact 51 as shown.

During manual tripping, push-to-trip button 80 is depressed which forces plate 88 downward rotating lift arm 82 about bar 86. This raises fingers 84 of lift arm 82 which also raises arms 94 of lift bracket 92 pulling one end of thermal bistable element in an upward direction. This allows blade 64 to move between contact 51 and 66.

While particular embodiments of the present invention have been disclosed, it is understood that various different modifications are possible and are contemplated within the true spirit and scope of the appended claims. For example, while a surface mount is described in detail the invention also covers through panel mounted breakers. There is no intention, therefore, of limitations to the exact abstract or disclosure herein presented.

What is claimed is:

1. A high amperage circuit breaker comprising a pair of spaced terminals being placed in series with the circuit to be protected;

a heat resistant electrical insulating plastic housing defining a body cavity, said body cavity having a base, a front wall, a rear wall and two side walls, a cover to close said housing;

a rectangular thermally activated bistable mechanical element in said cavity, at least one dimple formed on said bistable element;

a first contact being connected to one of said terminals, said first contact also connected to one end of said bistable element by means wherein the one end of said bistable element always remains stationary with respect to the first contact and in electrical contact with the first contact;

a second electrical contact attached to the other end of said bistable element;

said other end of said bistable element being free to move in a relatively vertical direction;

a third contact electrically connected to said other terminal and being positioned relative to said second contact wherein said second and third contact are normally in electrical contact with each other when the bistable element is in a first position, and said first position being to close the circuit of the circuit breaker;

said bistable element having a predetermined current response to quickly deflect when there is a predetermined over current, said deflection causing said other end of said bistable element to move from said first position to a second position and to cause said second contact to separate from said third contact by a predetermined distance to open the circuit of the circuit breaker;

a reset mechanism to maintain the predetermined distance between said second contact and said third contact until the circuit breaker is manually reset; and a manual trip means to open the circuit of the circuit breaker.

2. The circuit breaker of claim 1 wherein the bistable element has at least two dimples formed on the upper face and adjacent opposite sides of said bistable element, and said bistable element having a length greater than a width with said width being greater than ½ width.

3. The circuit breaker of claim 2 wherein;

a vertical plane passing through a center of said first contact and a center of said contact is perpendicular to a vertical plane passing through centers of said pair of dimples.

4. The circuit breaker of claim 3 wherein;

said first contact being connected to said one end of said bistable element by mechanical stake joint; and said second electrical contact attached to and extending from the underside of the other end of said bistable element.

5. The circuit breaker of claim 2 wherein the circuit breaker is a manual-reset, low voltage, DC, high-amp, surface mounted circuit breaker.

6. The breaker of claim 2 wherein the circuit breaker is a manual-reset, low voltage, DC, high-amp, through surface mounted circuit breaker.

7. The circuit breaker of claim 1 wherein said circuit breaker is a manual-reset breaker comprising;

a plastic rotatable shaft having one end rotatably mounted in the said cavity base;

said shaft other end extending out of said cover for a predetermined distance;

a pair of longitudinally spaced first and second integral bars extending from said rotatable shaft;

said second bar extending a predetermined distance from said first bar and being sized to provide predetermined electrical insulation, said second bar being in contact with the outer surface of said second contact when the electrical circuit is closed;

a spring attached to said first bar and said housing, said spring exerting a rotational force on said plastic shaft to urge the second bar in contact with and toward said second contact;

wherein when said second and third contacts are separated said shaft rotates to position said second bar between said second and third contacts and electrically separates said second and third contacts from each other.

8. The circuit breaker of claim 2 wherein said circuit breaker is a manual-reset breaker comprising;

a plastic rotatable shaft having one end rotatably mounted in the said cavity base;

said shaft's other end extending out of said cover for a predetermined distance;

a pair of longitudinally spaced first and second integral bars extending from said rotatable shaft;

said second bar extending a predetermined distance from said first bar and being sized to provide predetermined electrical insulation, said second bar being in contact with the outer surface of said second contact when the electrical circuit is closed;

a spring attached to said first bar and said housing, said spring exerting a rotational force on said plastic shaft to urge the second bar in contact with and toward said second contact;

wherein when said second and third contacts are separated said shaft rotates to position said second bar between said second and third contacts and electrically separates said second and third contacts from each other.

9. The circuit breaker of claim 1 wherein;

a blind hole is defined by said cavity base adjacent said rear wall;

said rotatable shaft having said one end rotatably mounted in said blind hole;

said first bar being adjacent the top of said housing;

said second bar being paddle shaped;

said first contact being connected to said one end of said bistable element by mechanical stake joint; and, said second electrical contact attached to and extending from the underside of the other end of said bistable element.

10. A circuit breaker as in claim wherein said trip means comprises;

a button;

a plate which is rotatably connected to fingers, such that when said button forces said plate downward said fingers move upward;

a bracket connected to said bistable element near said second contact and interconnected with said fingers so that when said fingers move upward, said bracket moves upward causing said bistable element to deform, opening said second and third contact.

11. A high amperage manual reset D.C. circuit breaker comprising;

a heat resistant electrical insulating plastic housing defining a rectangular central body cavity, with a base, front wall, a rear wall and two side walls;

a blind hole defined by said cavity base adjacent said rear wall;

a pair of spaced terminal bolts extending through said base with a pair of contact nuts being external of said housing, said spaced terminals being placed in series with the circuit to be protected;

an insulating plastic rotatable shaft having one end rotatably mounted in said blind hole and the other end extending out of said housing for a predetermined distance;

a cover to close said housing;

a seal placed between said housing and said cover to seal said cover to said housing;

means to permanently attach said cover to said shaft;

said shaft other end extending out of said cover for a predetermined distance;

a seal ring attached to said cover and said shaft;

a pair of longitudinally spaced first and second integral bars extending from said rotatable shaft;

said first bar being adjacent the top of said housing;

a paddle shaped bar extending a predetermined distance from said first bar, said second bar having a relatively straight side, said second bar being sized to provide predetermined electrical insulation.

a generally rectangular thermally activated bistable mechanical element, a pair of dimples formed on an upper surface of and adjacent opposite sides of said bistable element;

a first contact being connected to one of said terminals, said first contact also connected to end of said bistable element by a washer and a mechanical stake joint wherein the one end of said bistable element always remains stationary with respect to the first contact and in electrical contact with the first contact;

a second electrical contact attached to and extending from the underside of the other end of said second electrical contact;

said other end of said bistable element being free to move in a relatively vertical direction;

a vertical plane passing through a center of said first contact and a center of said second contact being perpendicular to a vertical plane passing through centers of said pair of dimples;

a third contact electrically connected to said other terminal and being positioned below said second contact, said second and third contact normally begin in electrical contact with each other to close the circuit of the circuit breaker;

said second bar having its side in contact with the outer surface of said second contact when the electrical circuit is closed;

a spring attached to said first bar and said housing, said spring exerting a rotational force on said plastic shaft to urge the second bar in contact with said second contact and toward said second contact;

said bistable element having a predetermined current response to quickly deform when there is a predetermined over current, said deformation causes said other end to vertically rise and to cause said second contact to separate from said third contact by a predetermined distance;

wherein said second and third contacts are separated said spring rotates to position said second bar between said second and third contacts and electrically separate second and third contacts from each other; and a manual trip means to cause said bistable element to deform, said deformation causes said second contact to separate form said third contact.

* * * * *